US008104512B2

(12) United States Patent
Nelson et al.

(10) Patent No.: US 8,104,512 B2
(45) Date of Patent: Jan. 31, 2012

(54) SPOUT TIP RETENTION METHOD

(75) Inventors: Alfred C. Nelson, Carmel, IN (US); Jeffrey L. Moore, Frankfort, IN (US); Kurt J. Thomas, Indianapolis, IN (US)

(73) Assignee: Masco Corporation of Indiana, Indianapolis, IN (US)

( * ) Notice: Subject to any disclaimer, the term of this patent is extended or adjusted under 35 U.S.C. 154(b) by 609 days.

(21) Appl. No.: 12/237,811

(22) Filed: Sep. 25, 2008

(65) Prior Publication Data

US 2010/0071778 A1 Mar. 25, 2010

(51) Int. Cl.
*F16K 21/00* (2006.01)

(52) U.S. Cl. ..... 137/801; 4/678

(58) Field of Classification Search ..... 137/801; 4/675–678

See application file for complete search history.

(56) References Cited

U.S. PATENT DOCUMENTS

| | | | | |
|---|---|---|---|---|
| 2,200,091 | A | 5/1940 | Kovach | |
| 2,219,471 | A | 10/1940 | Davis | |
| 2,468,315 | A * | 4/1949 | Wagner | 285/179 |
| 2,546,327 | A | 3/1951 | Young | |
| 2,548,933 | A | 4/1951 | Barnett | |
| 2,781,786 | A | 2/1957 | Young | |
| 2,884,007 | A | 4/1959 | Green | |
| 3,229,710 | A | 1/1966 | Keller, III | |
| 3,422,849 | A | 1/1969 | Manoogian | |
| 3,505,098 | A | 4/1970 | Miller et al. | |
| 3,520,325 | A | 7/1970 | Stuart | |
| 3,580,289 | A | 5/1971 | James et al. | |
| 3,590,876 | A | 7/1971 | Young | |
| 3,600,723 | A | 8/1971 | Mongerson et al. | |
| 3,757,824 | A | 9/1973 | Parkhurst et al. | |
| 3,796,380 | A | 3/1974 | Johnson et al. | |
| 3,807,453 | A | 4/1974 | Dom et al. | |
| 3,854,493 | A | 12/1974 | Farrell | |
| 3,965,936 | A | 6/1976 | Lyon | |
| 3,989,787 | A | 11/1976 | Scott, Jr. et al. | |
| 3,998,240 | A | 12/1976 | Liautaud | |
| 4,026,328 | A | 5/1977 | Nelson | |
| 4,076,279 | A | 2/1978 | Klotz et al. | |
| 4,103,709 | A | 8/1978 | Fischer | |
| 4,130,136 | A | 12/1978 | Garnier et al. | |
| 4,221,338 | A | 9/1980 | Shames et al. | |
| 4,316,870 | A | 2/1982 | Rowley | |
| 4,337,795 | A | 7/1982 | Argyris et al. | |
| 4,356,574 | A | 11/1982 | Johnson | |
| 4,357,957 | A | 11/1982 | Bisonaya et al. | |
| 4,387,738 | A | 6/1983 | Bisonaya et al. | |
| 4,415,389 | A | 11/1983 | Medford et al. | |
| 4,446,084 | A | 5/1984 | Rowley | |

(Continued)

FOREIGN PATENT DOCUMENTS

| | | |
|---|---|---|
| DE | 10133041 | 1/2003 |

(Continued)

OTHER PUBLICATIONS

Dadex Polydex—PPR Pipe System for Hot and Cold Water Supply and Distribution, 2005, 2 pgs.

(Continued)

*Primary Examiner* — Craig Schneider
(74) *Attorney, Agent, or Firm* — Baker & Daniels LLP

(57) ABSTRACT

An apparatus and method for assembling a faucet spout to retain a tube within a body of the faucet spout.

14 Claims, 10 Drawing Sheets

U.S. PATENT DOCUMENTS

| | | | |
|---|---|---|---|
| 4,453,567 | A | 6/1984 | MacDonald |
| 4,458,839 | A | 7/1984 | MacDonald |
| 4,484,600 | A | 11/1984 | Peterson et al. |
| 4,502,507 | A | 3/1985 | Hayman |
| 4,513,769 | A | 4/1985 | Purcell |
| 4,525,136 | A | 6/1985 | Rowley |
| 4,552,171 | A | 11/1985 | Farrell et al. |
| 4,577,835 | A | 3/1986 | Holycross et al. |
| 4,580,601 | A | 4/1986 | Schlotman et al. |
| 4,592,388 | A | 6/1986 | Wilcox |
| 4,607,659 | A | 8/1986 | Cole |
| 4,610,429 | A | 9/1986 | Arnold et al. |
| 4,626,005 | A | 12/1986 | Stifter |
| 4,635,673 | A | 1/1987 | Gerdes |
| 4,649,958 | A | 3/1987 | Purcell |
| 4,652,263 | A | 3/1987 | Herweck et al. |
| 4,664,423 | A | 5/1987 | Rowley |
| 4,667,987 | A | 5/1987 | Knebel |
| 4,687,025 | A | 8/1987 | Kahle et al. |
| 4,700,928 | A | 10/1987 | Marty |
| 4,708,172 | A | 11/1987 | Riis |
| 4,754,993 | A | 7/1988 | Kraynick |
| 4,760,871 | A | 8/1988 | Vijay |
| 4,762,143 | A | 8/1988 | Botnick |
| 4,773,348 | A | 9/1988 | Rowley |
| 4,783,303 | A | 11/1988 | Imgram |
| 4,803,033 | A | 2/1989 | Rowley |
| 4,838,304 | A | 6/1989 | Knapp |
| 4,853,164 | A | 8/1989 | Kiang et al. |
| 4,877,660 | A | 10/1989 | Overbergh et al. |
| 4,887,642 | A | 12/1989 | Bernat |
| 4,942,644 | A | 7/1990 | Rowley |
| 4,957,135 | A | 9/1990 | Knapp |
| 4,971,112 | A | 11/1990 | Knapp |
| 4,979,530 | A | 12/1990 | Breda |
| 5,001,008 | A | 3/1991 | Tokita et al. |
| 5,006,207 | A | 4/1991 | Peterman et al. |
| 5,027,851 | A | 7/1991 | Drees et al. |
| 5,053,097 | A | 10/1991 | Johansson et al. |
| 5,090,062 | A | 2/1992 | Hochstrasser |
| 5,095,554 | A | 3/1992 | Gloor |
| 5,100,565 | A | 3/1992 | Fujiwara et al. |
| 5,110,044 | A | 5/1992 | Bergmann |
| 5,127,814 | A | 7/1992 | Johnson et al. |
| 5,131,428 | A | 7/1992 | Bory |
| 5,148,837 | A | 9/1992 | Ågren et al. |
| 5,150,922 | A | 9/1992 | Nakashiba et al. |
| 5,219,185 | A | 6/1993 | Oddenino |
| 5,232,008 | A | 8/1993 | Jeffries et al. |
| 5,279,333 | A | 1/1994 | Lawerence |
| 5,366,253 | A | 11/1994 | Nakashiba et al. |
| 5,375,889 | A | 12/1994 | Nakashiba et al. |
| 5,397,102 | A | 3/1995 | Kingman |
| 5,417,242 | A | 5/1995 | Goncze |
| 5,493,873 | A | 2/1996 | Donselman et al. |
| 5,494,259 | A | 2/1996 | Peterson |
| 5,518,027 | A | 5/1996 | Saiki et al. |
| 5,527,503 | A | 6/1996 | Rowley |
| 5,553,935 | A | 9/1996 | Burnham et al. |
| 5,555,912 | A | 9/1996 | Saadi et al. |
| 5,558,128 | A | 9/1996 | Pawelzik et al. |
| 5,566,707 | A | 10/1996 | Ching et al. |
| 5,573,037 | A | 11/1996 | Cole et al. |
| 5,577,393 | A | 11/1996 | Donselman et al. |
| 5,579,808 | A | 12/1996 | Mikol et al. |
| 5,590,572 | A | 1/1997 | Valente |
| 5,611,093 | A | 3/1997 | Barnum et al. |
| 5,615,709 | A | 4/1997 | Knapp |
| 5,622,210 | A | 4/1997 | Crisman et al. |
| 5,622,670 | A | 4/1997 | Rowley |
| 5,642,755 | A | 7/1997 | Mark et al. |
| 5,660,692 | A | 8/1997 | Nesburn et al. |
| 5,669,407 | A | 9/1997 | Bailey |
| 5,669,417 | A | 9/1997 | Kuo |
| 5,669,595 | A | 9/1997 | Bytheway |
| 5,685,341 | A | 11/1997 | Chrysler et al. |
| 5,687,952 | A | 11/1997 | Arnold et al. |
| 5,695,094 | A | 12/1997 | Burnham et al. |
| 5,725,008 | A | 3/1998 | Johnson |
| 5,730,173 | A | 3/1998 | Sponheimer |
| 5,741,458 | A | 4/1998 | Rowley |
| 5,746,244 | A | 5/1998 | Woolley, Sr. et al. |
| 5,756,023 | A | 5/1998 | Stachowiak |
| 5,758,690 | A | 6/1998 | Humpert et al. |
| 5,775,587 | A | 7/1998 | Davis |
| 5,803,120 | A | 9/1998 | Bertoli |
| 5,813,435 | A | 9/1998 | Knapp |
| 5,833,279 | A | 11/1998 | Rowley |
| 5,850,855 | A | 12/1998 | Kerschbaumer et al. |
| 5,857,489 | A | 1/1999 | Chang |
| 5,861,200 | A | 1/1999 | Rowley |
| 5,865,473 | A | 2/1999 | Semchuck et al. |
| 5,875,809 | A | 3/1999 | Barrom |
| 5,893,387 | A | 4/1999 | Paterson et al. |
| 5,895,695 | A | 4/1999 | Rowley |
| 5,916,647 | A | 6/1999 | Weinstein |
| 5,924,451 | A | 7/1999 | Kuo |
| 5,927,333 | A | 7/1999 | Grassberger |
| 5,934,325 | A | 8/1999 | Brattoli et al. |
| 5,937,892 | A | 8/1999 | Meisner et al. |
| 5,944,225 | A | 8/1999 | Kawolics |
| 5,950,663 | A | 9/1999 | Bloomfield |
| 5,960,490 | A | 10/1999 | Pitch |
| 5,965,077 | A | 10/1999 | Rowley et al. |
| 5,975,143 | A | 11/1999 | Järvenkylä et al. |
| 5,979,489 | A | 11/1999 | Pitch |
| 6,013,382 | A | 1/2000 | Coltrinari et al. |
| 6,023,796 | A | 2/2000 | Pitch |
| 6,029,860 | A | 2/2000 | Donselman et al. |
| 6,029,948 | A | 2/2000 | Shafer |
| 6,053,214 | A | 4/2000 | Sjoberg et al. |
| 6,062,251 | A | 5/2000 | Pitch |
| 6,070,614 | A | 6/2000 | Holzheimer et al. |
| 6,070,916 | A | 6/2000 | Rowley |
| 6,073,972 | A | 6/2000 | Rivera |
| 6,079,447 | A | 6/2000 | Holzheimer et al. |
| 6,082,407 | A | 7/2000 | Paterson et al. |
| 6,082,780 | A | 7/2000 | Rowley et al. |
| 6,085,784 | A | 7/2000 | Bloom et al. |
| 6,116,884 | A | 9/2000 | Rowley et al. |
| 6,123,232 | A | 9/2000 | Donselman et al. |
| 6,131,600 | A | 10/2000 | Chang |
| 6,138,296 | A | 10/2000 | Baker |
| 6,155,297 | A | 12/2000 | MacAusland et al. |
| 6,161,230 | A | 12/2000 | Pitsch |
| 6,170,098 | B1 | 1/2001 | Pitsch |
| 6,177,516 | B1 | 1/2001 | Hudak |
| 6,202,686 | B1 | 3/2001 | Pitsch et al. |
| 6,227,464 | B1 | 5/2001 | Allmendinger et al. |
| 6,238,575 | B1 | 5/2001 | Patil |
| 6,256,810 | B1 | 7/2001 | Baker |
| 6,270,125 | B1 | 8/2001 | Rowley et al. |
| 6,287,501 | B1 | 9/2001 | Rowley |
| 6,293,336 | B1 | 9/2001 | Emerick, Sr. et al. |
| 6,296,017 | B2 | 10/2001 | Kimizuka |
| 6,305,407 | B1 | 10/2001 | Selby |
| 6,315,715 | B1 | 11/2001 | Taylor et al. |
| 6,328,059 | B1 | 12/2001 | Testori et al. |
| 6,334,466 | B1 | 1/2002 | Jani et al. |
| 6,341,617 | B1 | 1/2002 | Wilson |
| 6,349,733 | B1 | 2/2002 | Smith |
| 6,378,790 | B1 | 4/2002 | Paterson et al. |
| 6,385,794 | B1 | 5/2002 | Miedzius et al. |
| 6,464,266 | B1 | 10/2002 | O'Neill et al. |
| 6,485,666 | B1 | 11/2002 | Rowley |
| 6,557,907 | B2 | 5/2003 | Rowley |
| 6,609,732 | B1 | 8/2003 | Souvatzidis et al. |
| 6,635,334 | B1 | 10/2003 | Jackson et al. |
| 6,722,011 | B1 | 4/2004 | Bacon |
| 6,732,543 | B2 | 5/2004 | Jenkins, Jr. et al. |
| 6,770,376 | B2 | 8/2004 | Chen |
| 6,770,384 | B2 | 8/2004 | Chen |
| 6,783,160 | B2 | 8/2004 | Rowley |
| 6,803,133 | B2 | 10/2004 | Chen |
| 6,817,379 | B2 | 11/2004 | Perla |
| 6,835,777 | B2 | 12/2004 | Botros |
| 6,838,041 | B2 | 1/2005 | Rowley |

| | | | |
|---|---|---|---|
| 6,848,719 | B2 | 2/2005 | Rowley |
| 6,860,523 | B2 | 3/2005 | O'Neill et al. |
| 6,860,524 | B1 | 3/2005 | Rowley |
| 6,877,172 | B2 | 4/2005 | Malek et al. |
| 6,894,115 | B2 | 5/2005 | Botros |
| 6,902,210 | B1 | 6/2005 | Rowley |
| 6,920,899 | B2 | 7/2005 | Haenlein et al. |
| 6,959,736 | B2 | 11/2005 | Järvenkylä |
| 6,962,168 | B2 | 11/2005 | McDaniel et al. |
| 6,978,795 | B2 | 12/2005 | Perrin |
| 7,118,138 | B1 | 10/2006 | Rowley et al. |
| 7,225,828 | B2 | 6/2007 | Giagni et al. |
| 2002/0100139 | A1 | 8/2002 | Rowley |
| 2002/0167171 | A1 | 11/2002 | Becker et al. |
| 2004/0007278 | A1 | 1/2004 | Williams |
| 2004/0021120 | A1 | 2/2004 | Turnau, III et al. |
| 2004/0060608 | A1 | 4/2004 | Angus |
| 2004/0117906 | A1 | 6/2004 | Baker et al. |
| 2004/0150132 | A1 | 8/2004 | Rowley |
| 2004/0176503 | A1 | 9/2004 | Czayka et al. |
| 2005/0005989 | A1 | 1/2005 | Roloff |
| 2005/0194051 | A1 | 9/2005 | Pinette |
| 2006/0108705 | A1 | 5/2006 | Rowley |
| 2006/0118185 | A1 | 6/2006 | Nobili |
| 2006/0124183 | A1 | 6/2006 | Kuo |
| 2006/0130908 | A1 | 6/2006 | Marty et al. |
| 2006/0170134 | A1 | 8/2006 | Rowley et al. |
| 2006/0202142 | A1 | 9/2006 | Marty et al. |
| 2007/0044852 | A1 | 3/2007 | Pinette |
| 2007/0137714 | A1 | 6/2007 | Meehan et al. |
| 2007/0137718 | A1 | 6/2007 | Rushlander et al. |
| 2008/0178935 | A1 | 7/2008 | Thomas |
| 2008/0178954 | A1 | 7/2008 | Pinette et al. |
| 2008/0308165 | A1 | 12/2008 | Meehan et al. |

FOREIGN PATENT DOCUMENTS

| | | |
|---|---|---|
| EP | 0 632 220 | 1/1995 |
| EP | 0 808 952 | 11/1997 |
| JP | 3094877 | 4/1991 |
| JP | 200132343 | 6/2001 |
| WO | WO 91/05191 | 4/1991 |
| WO | WO 00/61831 | 10/2000 |
| WO | WO 02/25022 | 3/2002 |
| WO | WO 2005/108829 | 11/2005 |

OTHER PUBLICATIONS

Dadex Polydex, 2005, 1 pg.

Dow, Plastic Pipes Europe, Middle East & Africa, Hot and Cold Water Pipes, 2007, 1 pg.

Dow, Plastic Pipes Europe, Middle East, & Africa, Dowlex PE-RT, 2007, 2 pgs.

Kerox, Standard Cartridges, 2005, 3 pgs.

PEX Association, What is PE-X?, undated, 7 pgs.

Ticona Engineering Polymers, Engineering Polymers for Innovative Applications catalog, Mar. 2006, 16 pgs.

Noveon, Inc.; Processing with TempRite® PEX Ensures Quality Piping, downloaded Dec. 17, 2004 from www.tempritepex.com/processingInstallation/processing.asp, 2 pgs.

SpecialChem S.A., Silane Crosslinking Agents Center, Crosslinking Mechanism, downloaded Dec. 17, 2004 from www.specialchem4polymers.com/tc/silane-crosslinking-agents/index.aspx?id=mechanism, 2 pgs.

International Search Report and Written Opinion in application No. PCT/US09/58241, dated Nov. 24, 2009, 9 pgs.

Kerox, Ceramic Mixing Cartridge, Conventional Single-Lever Type, Model K-28, at least as early as May 21, 2007, 2 pgs.

PPI Plastics Pipe Institute, Crosslinked Polyethylene (PEX) Tubing, TN-17/2001, www.plasticpipe.org/pdf/pubs/notes/tn17-01.pdf, Jun. 2001, 7 pgs.

* cited by examiner

SPOUT TIP RETENTION METHOD

BACKGROUND AND SUMMARY

The present disclosure relates to an apparatus and method for assembling a faucet spout. More particularly, the present disclosure relates to an apparatus and method for assembling the faucet spout to retain a tube within a body of the faucet spout.

A faucet spout includes a body having an inlet end and an outlet end and a tube received therein for delivering water from a water source through the body. In certain embodiments, the tube may be molded to a diverter valve. For example, the tube may be molded to the diverter valve as set forth in U.S. Patent Publication No. 2008/0178935, filed Jan. 31, 2007, entitled "DIVERTER INTEGRATED INTO A SIDE SPRAYER," and U.S. Provisional Patent Application No. 61/128,463, filed May 21, 2008, entitled "INTEGRATED KITCHEN FAUCET SIDE SPRAY AND DIVERTER," the disclosures of which are expressly incorporated by reference herein. However, the size of the diverter valve may prevent the tube from being inserted into the outlet end of the spout body and secured at the inlet end of the spout body.

According to an embodiment of the present disclosure, a faucet is provided that includes a spout body, a tube, an insert, and a clip. The spout body has an inlet end and an outlet end and defines a chamber extending between the inlet end and the outlet end. The tube is received within the chamber of the spout body. The tube has a tip disposed proximal the outlet end of the spout body, the tip having a first shoulder. The insert is configured to couple to the outlet end of the spout body, the insert having a second shoulder. The first shoulder of the tip is configured to prevent the tube from advancing from the spout body in a first direction. The clip is configured to engage the second shoulder of the insert to prevent the tube from withdrawing into the spout body in a second direction.

According to another embodiment of the present disclosure, an apparatus is provided that is configured to retain a spout tube within a spout body of a faucet, the spout tube having a tip. The apparatus includes a clip having a substantially C-shaped body. The clip is configured to collapse within an outer periphery of the spout tip in a first position, and the clip is configured to expand beyond the outer periphery of the spout tip in a second position.

According to yet another embodiment of the present disclosure, a method is provided for retaining a spout tube within a spout body of a faucet. The spout tube has a tip, and the spout body has an inlet end, an outlet end, and a chamber. The method includes the steps of providing a clip and an insert, positioning the spout tube within the chamber of the spout body with the tip of the spout tube located proximal the outlet end of the spout body, moving the tip of the spout tube into the insert until the clip expands outwardly relative to the tip and into engagement with the insert, and securing the insert to the outlet end of the spout body.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the invention and such exemplifications are not to be construed as limiting the scope of the invention in any manner.

DETAILED DESCRIPTION

Figure 1:
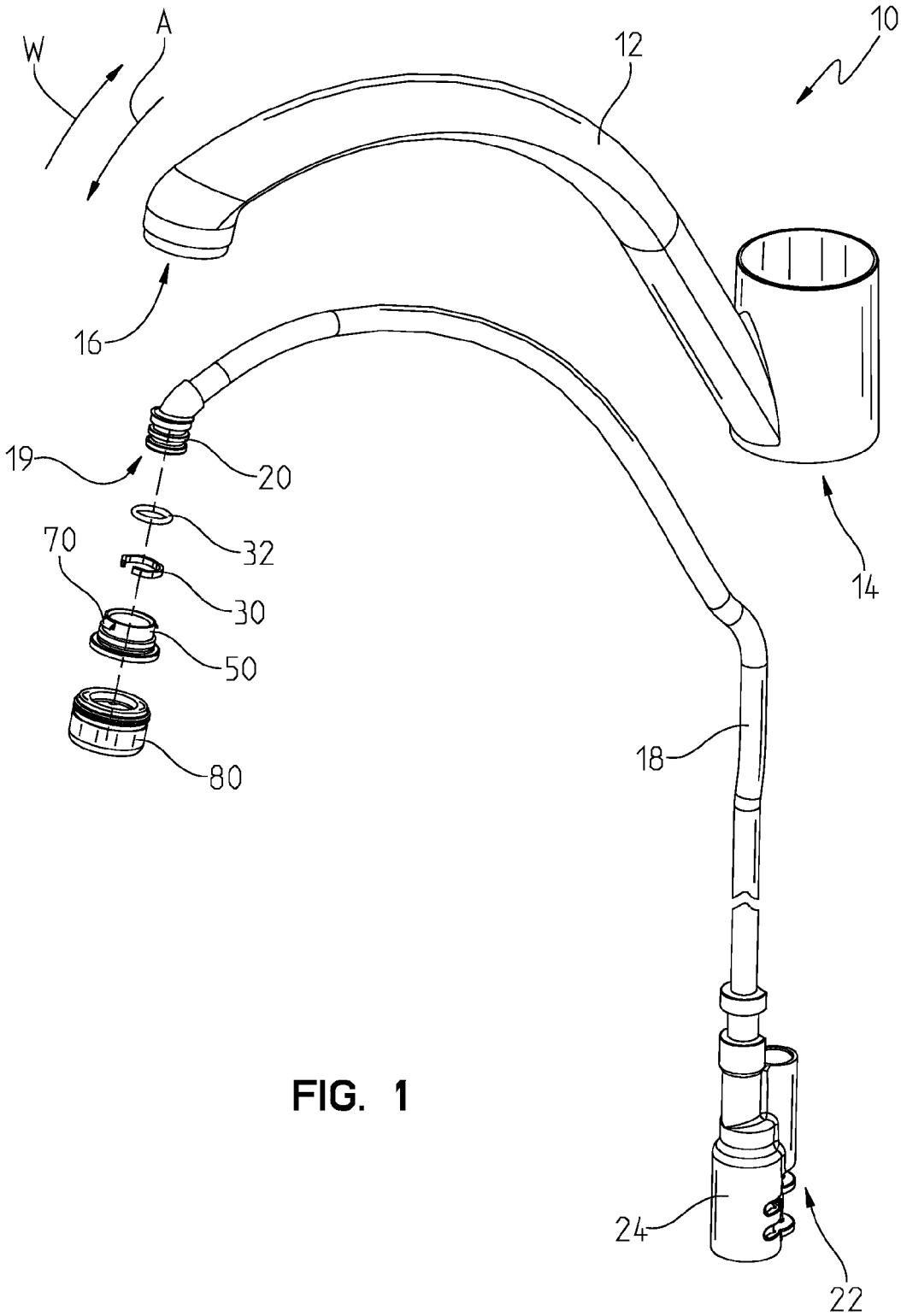
FIG. 1 is an exploded perspective view of an illustrative faucet spout of the present disclosure.
Figure 1A:
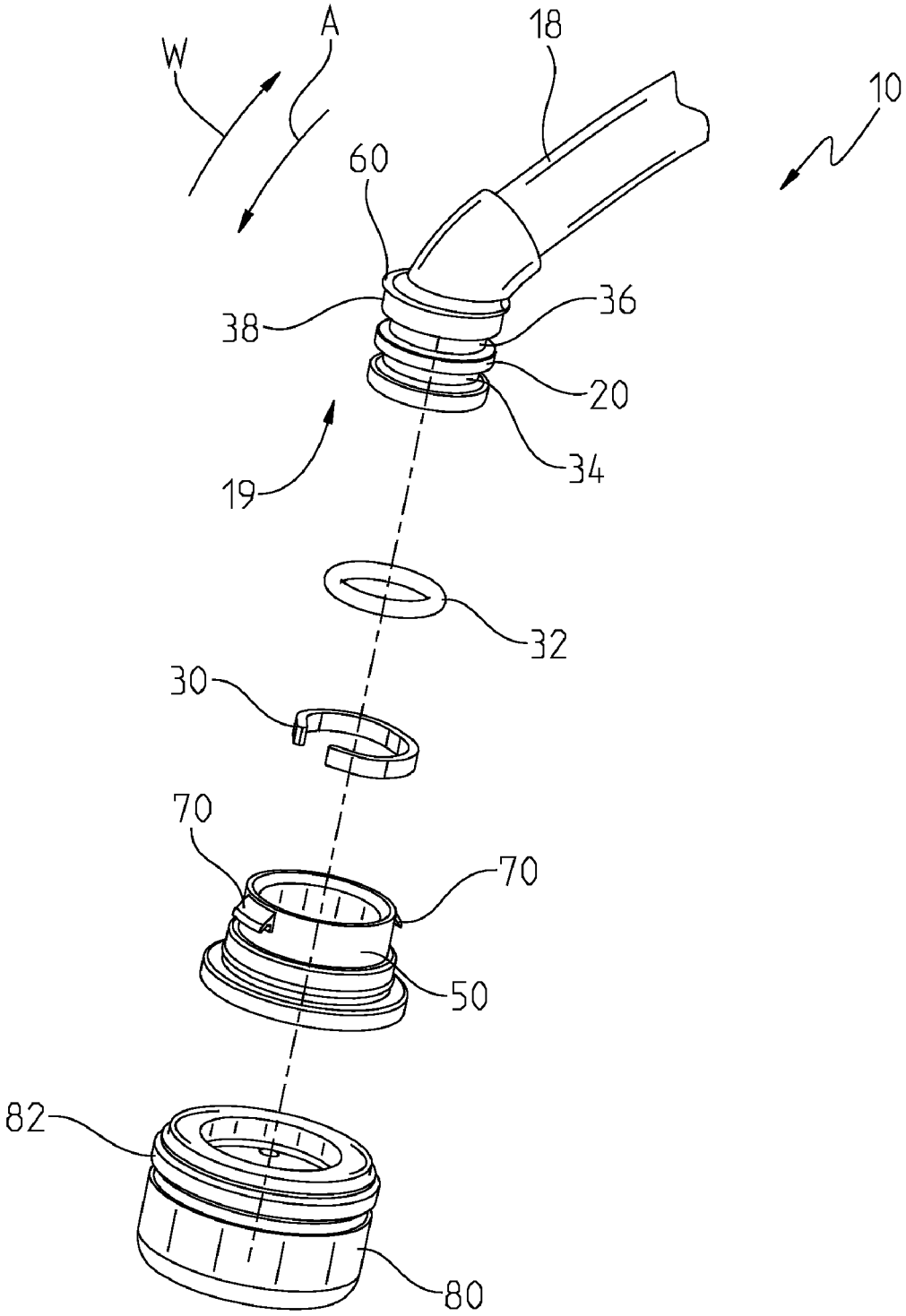
FIG. 1A is a partial exploded perspective view of the faucet spout of FIG. 1.

As shown in FIG. 1, faucet spout 10 includes delivery spout body 12 having inlet end 14 and outlet end 16. A chamber (not shown) extends within spout body 12 between inlet end 14 and outlet end 16. Spout body 12 may be formed of a rigid metal, such as brass, steel, zinc, or chrome, a rigid plastic, or a rigid ceramic, for example.

Figure 1B:
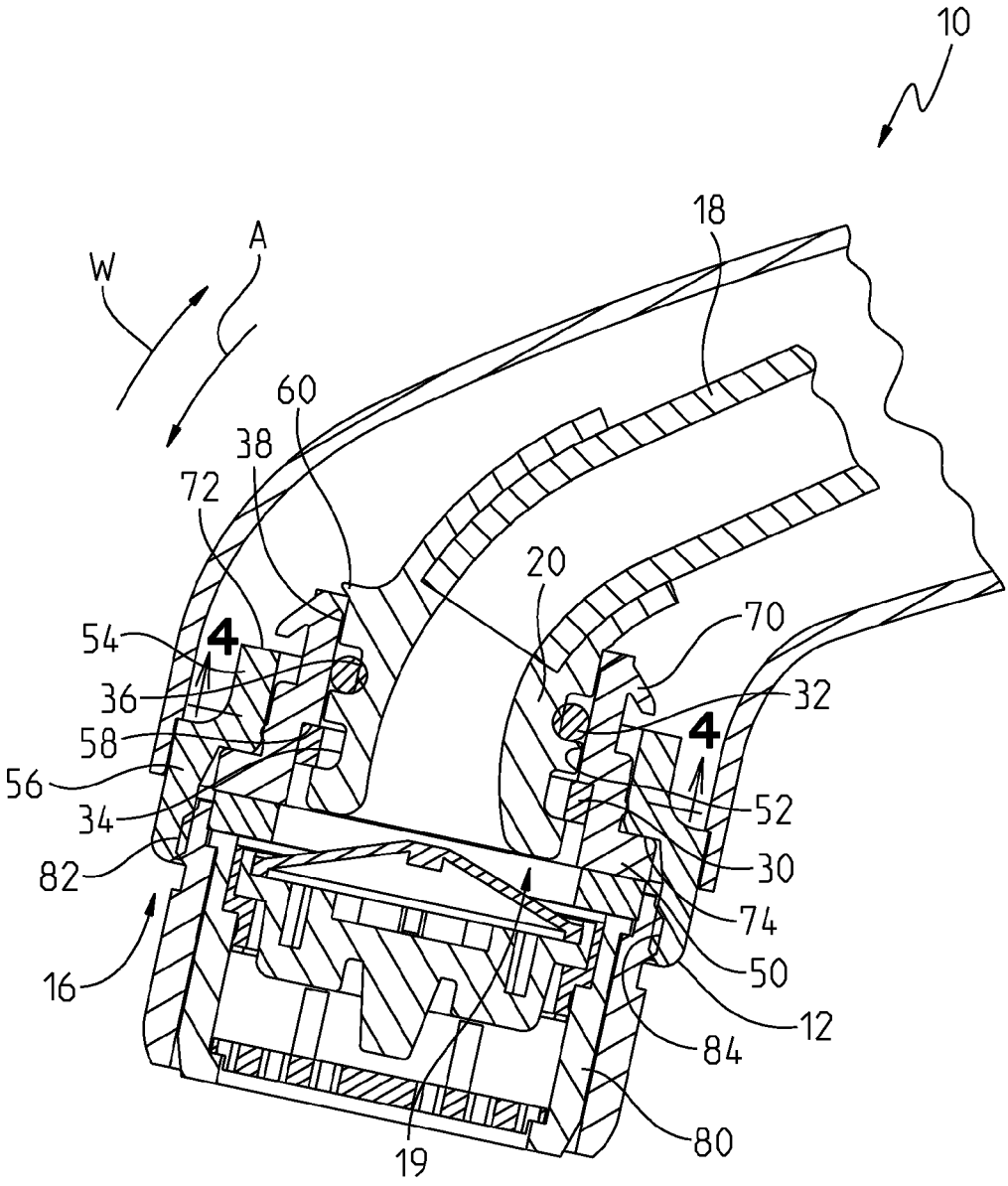
FIG. 1B is a partial assembled cross-sectional view of the faucet spout of FIG. 1.

Referring still to FIG. 1, faucet spout 10 also includes liner or tube 18. Tube 18 extends between delivery end 19 and receiving end 22. Delivery end 19 of tube 18 includes tip 20 coupled to tube 18, while receiving end 22 of tube 18 includes diverter valve 24 coupled to tube 18. In one embodiment, tip 20 may be overmolded to tube 18. In another embodiment, diverter valve 24 may be overmolded to tube 18. In yet another embodiment, both tip 20 and diverter valve 24 may be overmolded to tube 18. As shown in FIG. 1B, tip 20 may be overmolded to tube 18 at an angle offset from the axis of tube 18 to facilitate positioning tube 18 and tip 20 in a curved spout body 12. Such an attachment may be achieved using a curved core during the overmolding process. The molded attachments of tip 20 to tube 18 and diverter valve 24 to tube 18 may reduce water leakage between the components. When assembled, tube 18 is received within the chamber of spout body 12 and is in fluid communication with a water source, illustratively through at least one control valve (not shown), to deliver water from inlet end 14 to outlet end 16 of spout body 12. Specifically, when assembled, tip 20 at delivery end 19 of tube 18 is positioned proximal outlet end 16 of spout body 12 and diverter valve 24 at receiving end 22 of tube 18 is positioned proximal inlet end 14 of spout body 12. Tube 18 may be formed of a flexible, polymeric material, such as a cross-linked polyethylene (PEX) material. In certain embodiments, tube 18 may be made from a pre-formed PEX tubing or a corrugated PEX tubing to increase flexibility.

As shown in FIGS. 1-4A, an exemplary method is provided for assembling a faucet spout. The assembly of faucet spout 10 (FIGS. 1-1B) is substantially the same as the assembly of faucet spout 10' (FIGS. 2-2B), except as distinguished below. Corresponding parts of faucet spouts 10, 10', are labeled with corresponding reference numerals.

A step of the present method involves securing clip 30 and, optionally, sealing ring 32, to tip 20 of tube 18. Tip 20 of tube 18 has an outer periphery 38. Tip 20 of tube 18 also includes two annular grooves, 34, 36, set into outer periphery 38 of tip 20 and sized to receive clip 30 and sealing ring 32. Sealing ring 32 may be an elastomeric O-ring, for example, to provide a seal around tip 20 of tube 18.

Figure 3:
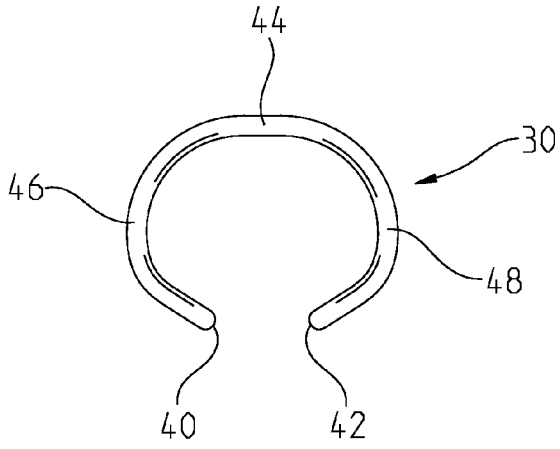
FIG. 3 is a plan view of an illustrative clip of the present disclosure.
Figure 4:
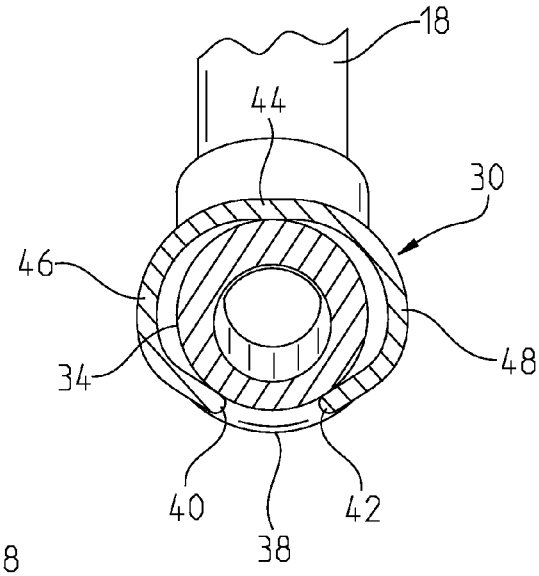
FIG. 4 is a cross-sectional view of the faucet spout of FIG. 1B, taken along line 4-4 of FIG. 1B, showing a clip in an expanded position.
Figure 4A:
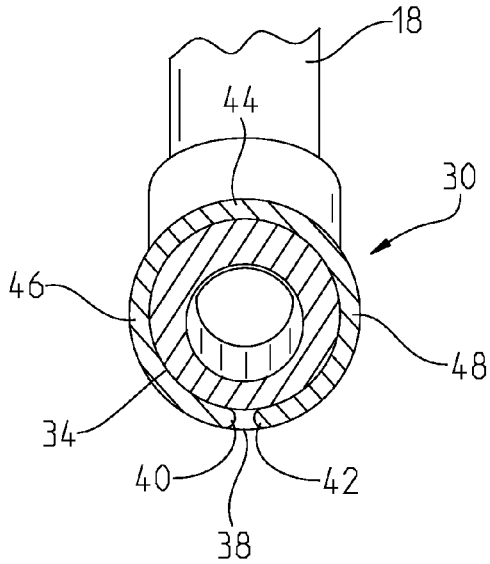
FIG. 4A is a cross-sectional view similar to FIG. 4 showing the clip in a collapsed position.

As shown in FIG. 3, clip 30 is a substantially C-shaped body with two terminal ends 40, 42, and middle section 44 located between terminal ends 40, 42. Clip 30 may be constructed of an elastomeric material, such as plastic. In a naturally expanded position, illustrated in FIG. 4, clip 30 may be received within annular groove 34 of tip 20 and may extend beyond outer periphery 38 of tip 20. Specifically, first expansion section 46 located between terminal end 40 and middle section 44, and second expansion section 48 located between terminal end 42 and middle section 44, may extend beyond outer periphery 38 of tip 20. In the expanded position, terminal ends 40, 42, and middle section 44 of clip 30 engage tip 20 to secure clip 30 to tip 20 of tube 18. Clip 30 is naturally biased toward this expanded position. In a collapsed position, illustrated in FIG. 4A, clip 30 may be received within annular groove 34 of tip 20 without extending beyond outer periphery 38 of tip 20. Specifically, terminal ends 40, 42, may be forced together such that first expansion section 46 and second expansion section 48 fit within outer periphery 38 of tip 20. Thus, in both the expanded position and the collapsed position, terminal ends 40, 42, and middle section 44 of clip 30 may engage tip 20, while expansion sections 46, 48, may engage tip 20 in the collapsed position. The elastic construction of clip 30 allows clip 30 to be collapsed and expanded. It is within the scope of the present disclosure that the shape of clip 30 may be modified while still providing for the collapse and expansion of clip 30.

After securing clip 30 and, optionally, sealing ring 32, to tip 20 of tube 18, tip 20 of tube 18 is inserted into spout body 12. To accommodate diverter valve 24 which may be integrally molded to receiving end 22 of tube 18, tip 20 of tube 18 is inserted into inlet end 14 of spout body 12 and through the chamber until reaching outlet end 16 of spout body 12. As a result, tip 20 at delivery end 19 of tube 18 is positioned proximal outlet end 16 of spout body 12 and diverter valve 24 at receiving end 22 of tube 18 is positioned proximal inlet end 14 of spout body 12. Because diverter valve 24 may not fit through the chamber of spout body 12, feeding tip 20 into inlet end 14 of spout body 12 allows diverter valve 24 to be integrally molded to receiving end 22 of tube 18 and appropriately positioned proximal inlet end 14 of spout body 12.

Another step of the present method involves moving tip 20 of tube 18 into insert 50. Insert 50 includes inner wall 52 and has a tapered or narrowed portion 54 and widened portion 56. Inner wall 52 forms first shoulder 58 between narrowed portion 54 and widened portion 56. The inner diameter of insert 50 increases along first shoulder 58 between narrowed portion 54 and widened portion 56.

Tip 20 of tube 18 is first inserted into narrowed portion 54 of insert 50. Outer periphery 38 of tip 20 is sized to fit within narrowed portion 54 of insert 50. Clip 30, which is located in annular groove 34 of tip 20, is forced into the collapsed position of FIG. 4A. In this collapsed position, clip 30 does not extend beyond outer periphery 38 of tip 20, so tip 20 fits within narrowed portion 54 of insert 50. Inner wall 52 of insert 50 may contact clip 30 to prevent clip 30 from expanding outwardly.

Tip 20 of tube 18 is then inserted beyond narrowed portion 54 and into widened portion 56 of insert 50, as shown in FIG. 1B. Inner wall 52 of insert 50 in widened portion 56 no longer prevents the expansion of clip 30, so clip 30 expands outwardly relative to tip 20 into the expanded position of FIG. 4. Once clip 30 expands, tip 20 of tube 18 becomes trapped or locked within insert 50. First shoulder 58 prevents tip 20 of tube 18 from withdrawing from insert 50 into spout body 12, specifically toward inlet end 14 of spout body 12, in a direction indicated by arrow W. According to an exemplary embodiment of the present disclosure, sealing ring 32 located in annular groove 36 of tip 20 contacts inner wall 52 of insert 50 to seal tip 20 of tube 18 and insert 50 when tip 20 is locked within insert 50.

Tip 20 of tube 18 includes second shoulder 60 that extends beyond outer periphery 38 of tip 20 and that at least partially surrounds tip 20. When tip 20 of tube 18 is locked within insert 50, second shoulder 60 may abut insert 50 to prevent tip 20 of tube 18 from advancing through insert 50, specifically toward outlet end 16 of spout body 12, in a direction indicated by arrow A. A direction indicated by arrow A is substantially opposite a direction indicated by arrow W. According to an exemplary embodiment of the present disclosure, sealing ring 32 located in annular groove 36 of tip 20 is positioned between clip 30 located in annular groove 34 of tip 20 and second shoulder 60 of tip 20. In this exemplary arrangement, tube 18 and insert 50 are in a sealed and locked engagement, in which first shoulder 58 of insert 50 and clip 30 prevent tip 20 of tube 18 from withdrawing from insert 50 in a direction indicated by arrow W, and second shoulder 60 of tip 20 prevents tip 20 from advancing through insert 50 in a direction indicated by arrow A.

Another step of the present method involves securing insert 50, and tube 18 locked therein, to outlet end 16 of spout body 12. Insert 50 may include a snap component 70 that is configured to engage spout body 12, for example. It is also within the scope of the present disclosure that insert 50 and spout body 12 may be secured together using a threaded connection or another suitable connection.

According to an embodiment of the present disclosure, illustrated in FIG. 1B, insert 50 includes two flexible snap components 70 that engage third shoulder 72 of spout body 12. Snap components 70 are compressed against insert 50 as insert 50 is pressed into outlet end 16 of spout body 12, and then snap components 70 snap outward beyond third shoulder 72 of spout body 12. The interaction between snap components 70 and third shoulder 72 prevents insert 50, and tube 18 locked therein, from advancing through spout body 12 in a direction indicated by arrow A. Spout body 12 also includes fourth shoulder 74. Insert 50 is larger at its base to engage fourth shoulder 74, which prevents insert 50, and tube 18 locked therein, from withdrawing into spout body 12 in a direction indicated by arrow W. In this arrangement, tube 18 is sealed and locked within insert 50, and insert 50 is locked within spout body 12.

Figure 2:
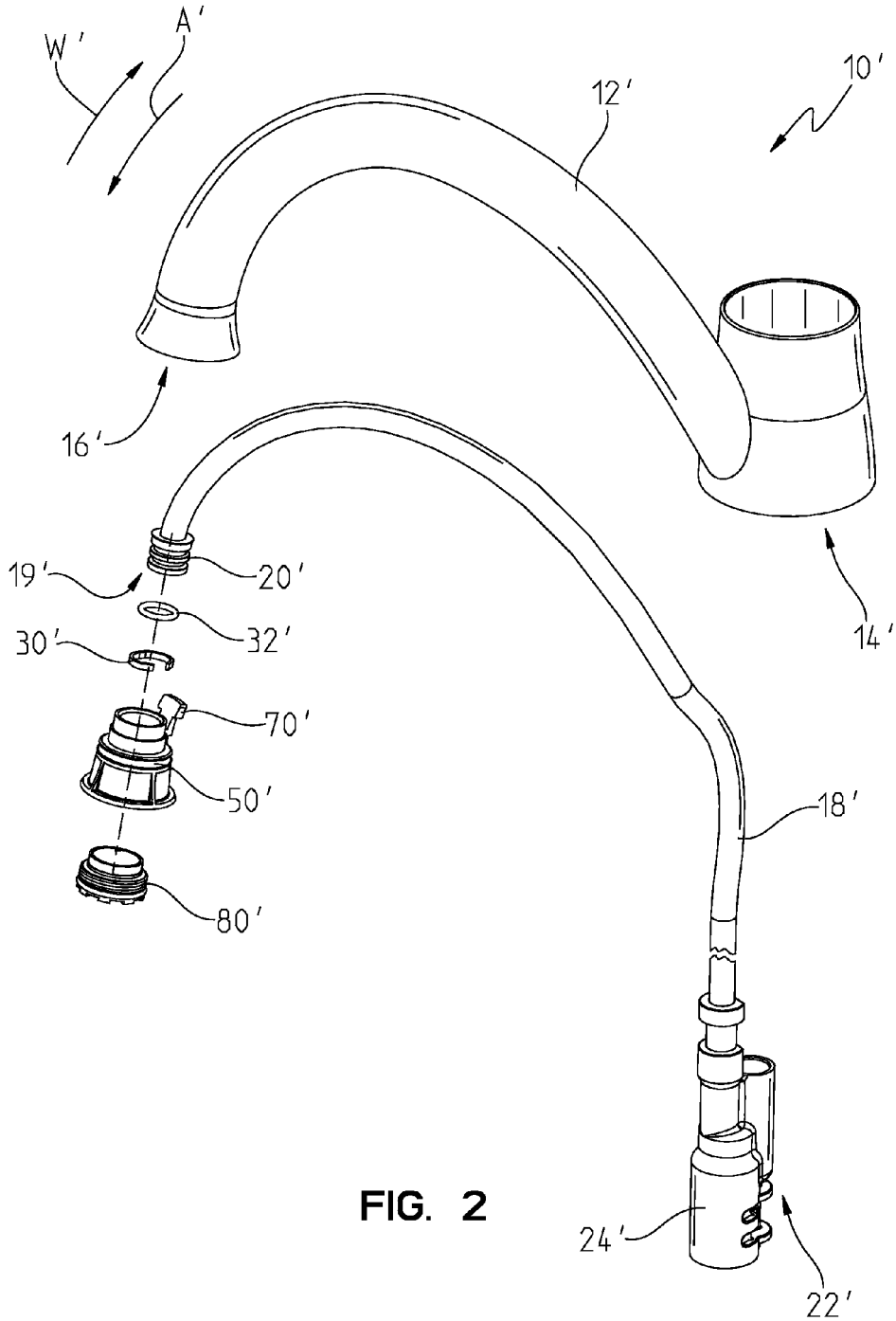
FIG. 2 is an exploded perspective view of another illustrative faucet spout of the present disclosure.
Figure 2A:
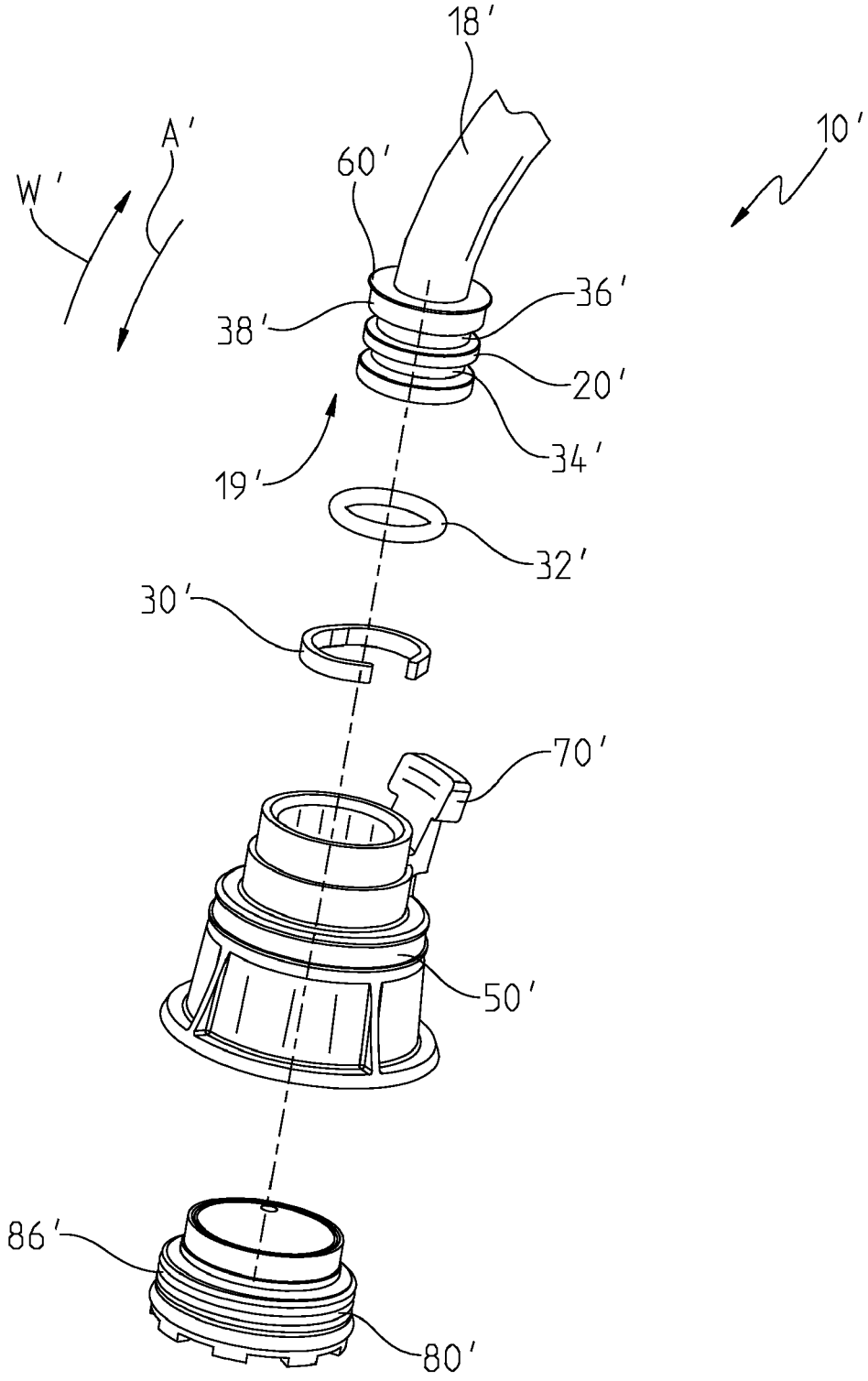
FIG. 2A is a partial exploded perspective view of the faucet spout of FIG. 2.
Figure 2B:
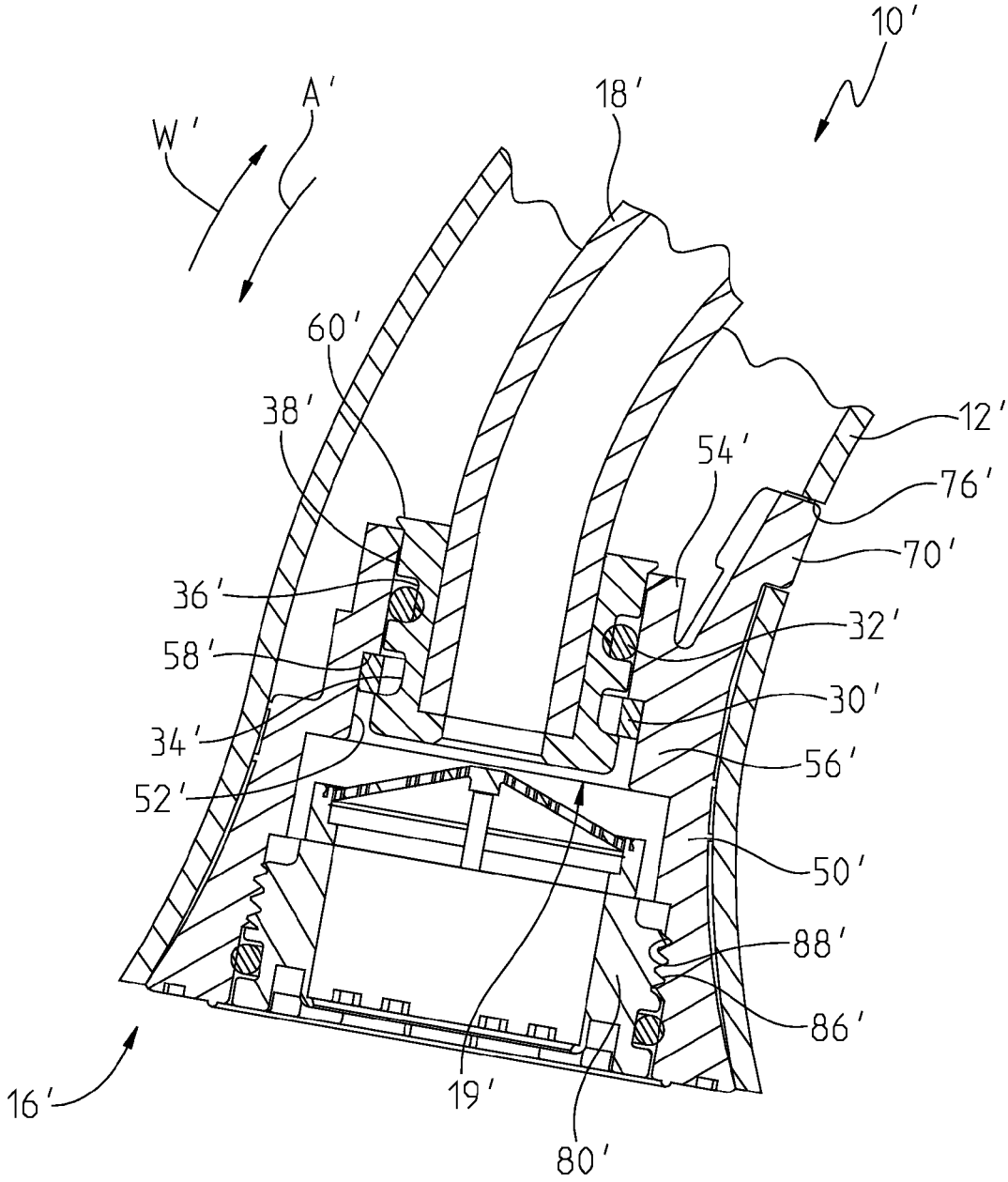
FIG. 2B is a partial assembled cross-sectional view of the faucet spout of FIG. 2.

According to another embodiment of the present disclosure, illustrated in FIG. 2B, insert 50' includes one flexible snap component 70' that is received within window 76' in spout body 12'. Snap component 70' is compressed against insert 50' as insert 50' is pressed into outlet end 16' of spout body 12', and then snap component 70' snaps outward and into window 76' in spout body 12'. The engagement between snap component 70' and window 76' prevents insert 50', and tube 18' locked therein, from advancing through spout body 12' in a direction indicated by arrow A' and from withdrawing into spout body 12' in a direction indicated by arrow W'. In this arrangement, tube 18' is sealed and locked within insert 50', and insert 50' is locked within spout body 12'.

Another step of the present method involves coupling aerator 80 to outlet end 16 of spout body 12. Aerator 80 provides for proper discharge of water from faucet spout 10. Advantageously, because tube 18 is sealed and locked within insert 50, and insert 50 is locked within spout body 12, aerator 80 may be cleaned and/or replaced without disturbing the other components. For example, removing aerator 80 will not cause tube 18 to retract or withdraw into spout body 12 in a direction indicated by arrow W.

According to an embodiment of the present disclosure, aerator 80 may be designed to attach directly to spout body 12, as shown in FIG. 1B. For example, aerator 80 may include an annular ridge 82, and spout body 12 may include an annular groove 84 configured to receive annular ridge 82. Annular ridge 82 may be made of a resilient material such that aerator 80 can be press fit into spout body 12 to engage annular groove 84 and removed when necessary.

According to another embodiment of the present disclosure, aerator 80' may be designed to attach directly to insert 50', as shown in FIG. 2B. For example, aerator 80 may include male threads 86' and insert 50' may include female threads 88' configured to threadably engage male threads 86'. In another embodiment, aerator 80' may be snapped into place within insert 50'. Such attachments facilitate removal of aerator 80' when necessary.

Figure 5:
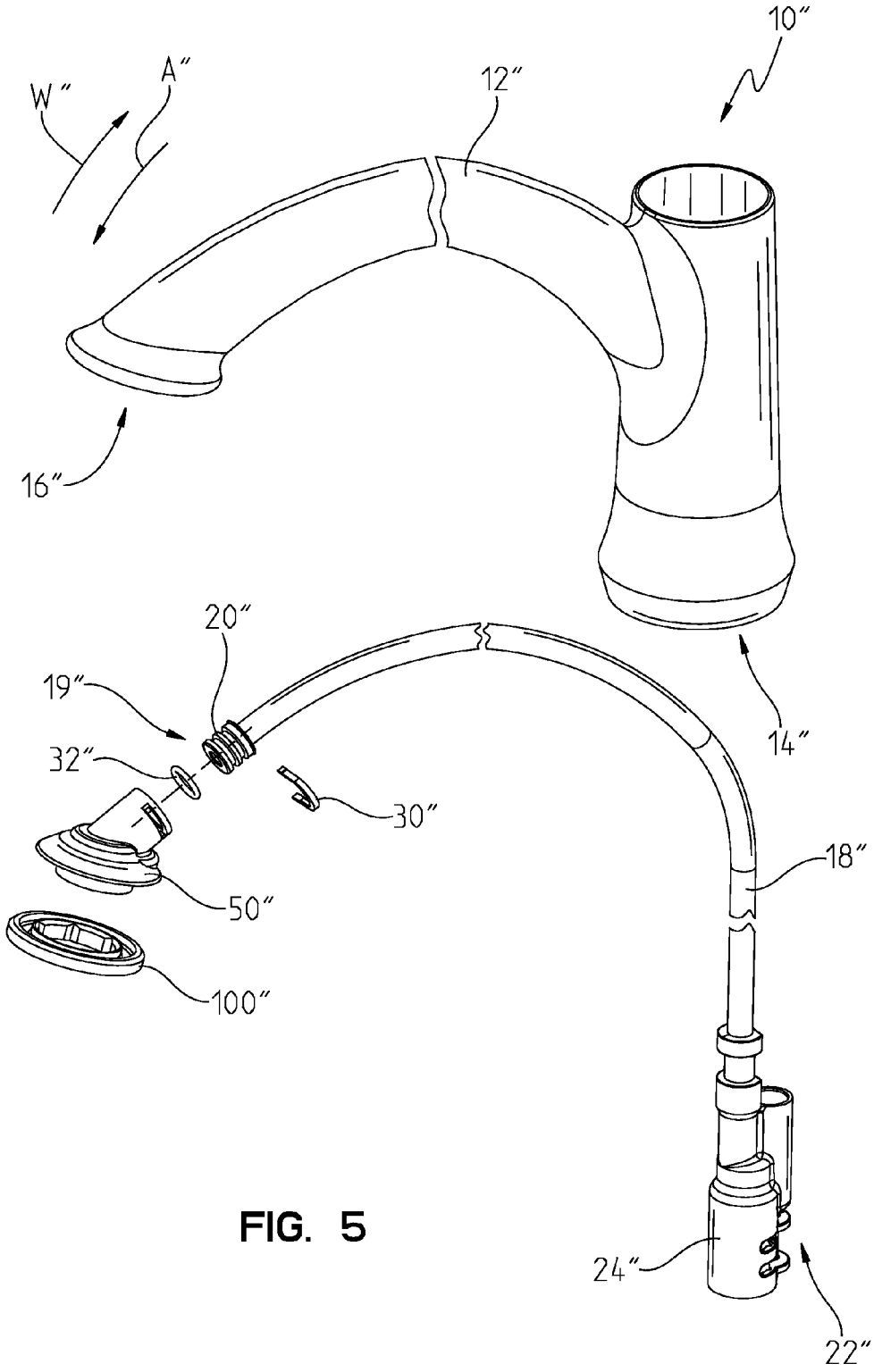
FIG. 5 is an exploded perspective view of yet another illustrative faucet spout of the present disclosure.
Figure 5A:
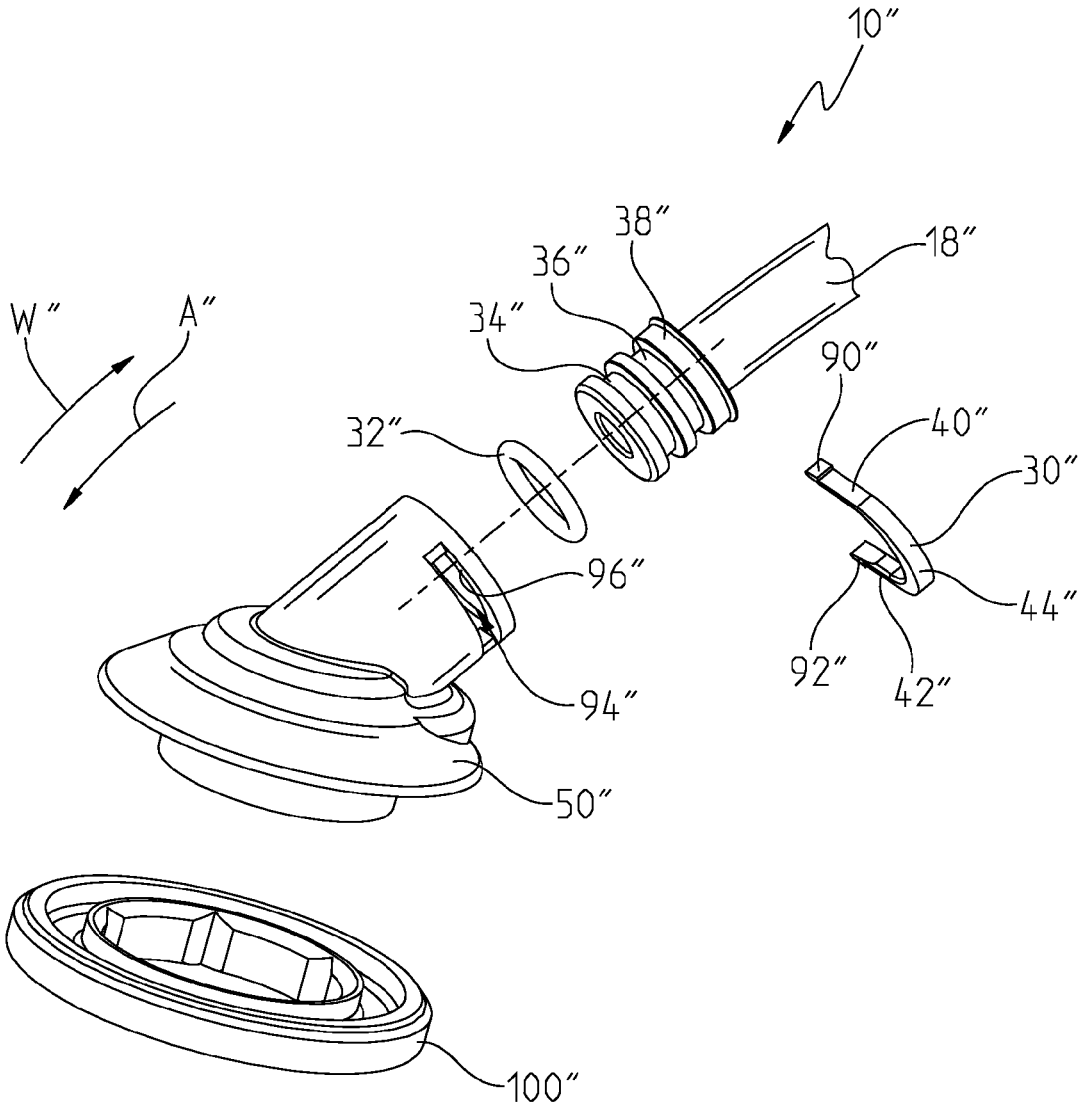
FIG. 5A is a partial exploded perspective view of the faucet spout of FIG. 5.
Figure 5B:
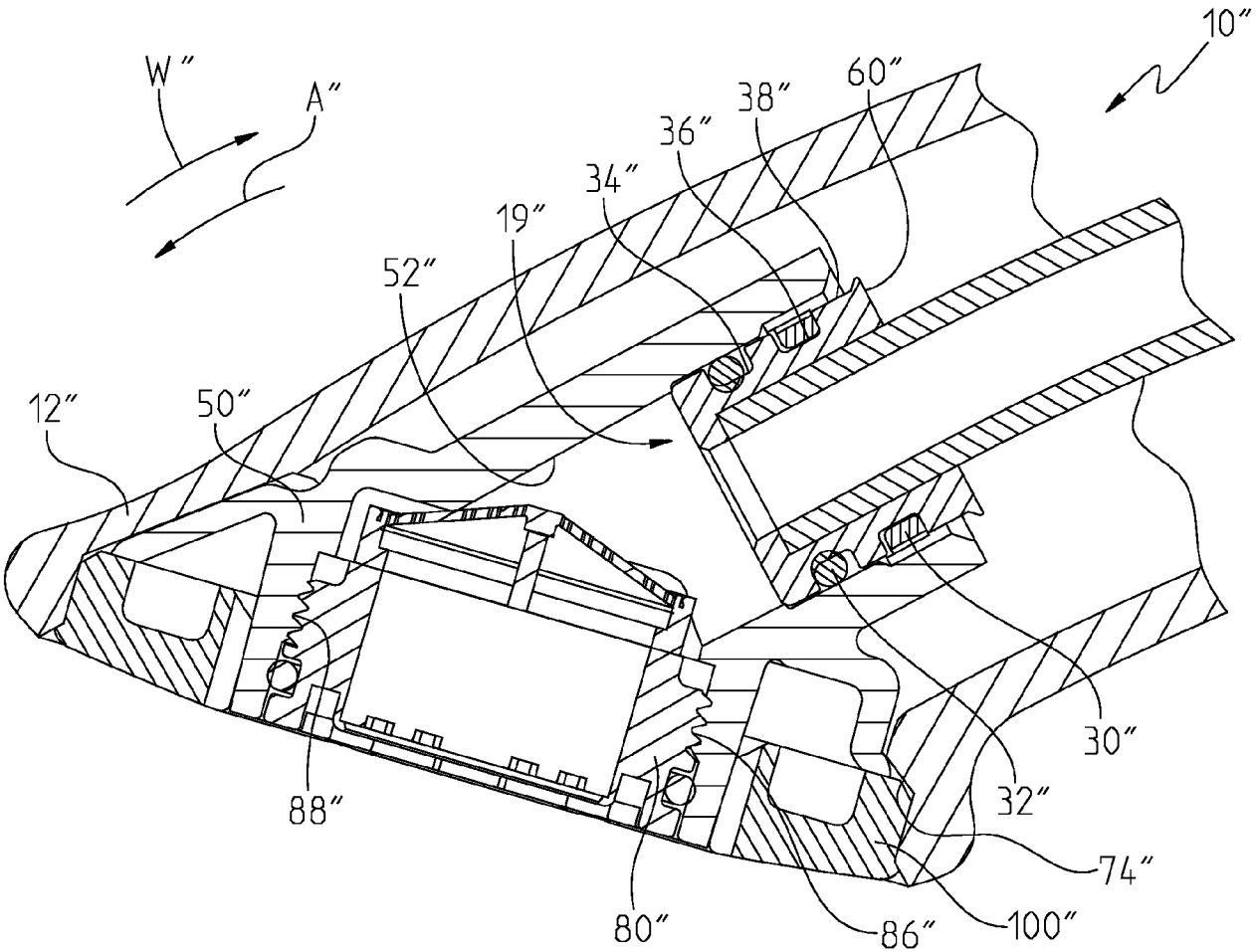
FIG. 5B is a partial assembled cross-sectional view of the faucet spout of FIG. 5.

As shown in FIGS. 5-5B, another exemplary method is provided for assembling faucet spout 10". Parts of faucet spout 10" that correspond to faucet spout 10 (FIGS. 1-1B) and faucet spout 10' (FIG. 2-2B), are labeled with corresponding reference numerals.

A step of the present method involves optionally securing sealing ring 32" to tip 20" of tube 18". Tip 20" of tube 18" has an outer periphery 38". Tip 20" of tube 18" also includes two annular grooves, 34", 36", set into outer periphery 38" of tip 20". Sealing ring 32" is inserted into annular groove 34", while annular groove 36" is left open to receive clip 30". Sealing ring 32" may be a rubber O-ring, for example, to provide a seal around tip 20" of tube 18".

After securing sealing ring 32" to tip 20" of tube 18", tip 20" of tube 18" is inserted into spout body 12". To accommodate diverter valve 24" which may be integrally molded to receiving end 22" of tube 18", tip 20" of tube 18" is inserted into inlet end 14" of spout body 12" and through the chamber until reaching outlet end 16" of spout body 12". As a result, tip 20" at delivery end 19" of tube 18" is positioned proximal outlet end 16" of spout body 12" and diverter valve 24" at receiving end 22" of tube 18" is positioned proximal inlet end 14" of spout body 12". Because diverter valve 24" may not fit through the chamber of spout body 12", feeding tip 20" into inlet end 14" of spout body 12" allows diverter valve 24" to be integrally molded to receiving end 22" of tube 18" and appropriately positioned proximal inlet end 14" of spout body 12".

Another step of the present method involves moving tip 20" of tube 18" into insert 50". Insert 50" includes inner wall 52" that contacts outer periphery 38" of tip 20" and sealing ring 32" to provide a sealed engagement between insert 50" and tube 18". Tip 20" of tube 18" includes second shoulder 60" that extends beyond outer periphery 38" of tip 20". Second shoulder 60" may abut insert 50" to prevent tip 20" of tube 18" from advancing through insert 50", specifically toward outlet end 16" of spout body 12", in a direction indicated by arrow A".

After tip 20" of tube 18" is inserted into insert 50", another step of the present method involves securing tip 20" of tube 18" in place using clip 30". As shown in FIG. 5A, clip 30" is a substantially C-shaped body with two terminal ends 40", 42", and middle section 44" located between terminal ends 40", 42". Clip 30" may be constructed of an elastomeric material, such as plastic. Clip 30" has a naturally expanded position, in which terminal ends 40", 42", of clip 30" are located farther apart than when clip 30" is compressed. Terminal ends 40", 42", of clip 30" include tabs 90", 92". During assembly, tip 20" is pressed into insert 50" until annular groove 36" of tip 20" is aligned with window 94" of insert 50". Terminal ends 40", 42", of clip 30" are inserted through window 94" to position clip 30" within annular groove 36" of tip 20". Initially, inner wall 52" of insert 50" forces clip 30" into a compressed position within annular groove 36". Eventually, terminal ends 40", 42", of clip 30" are pressed beyond a shoulder (not shown) of insert 50" such that ends 40", 42", of clip 30" are permitted to expand outwardly. Tabs 90", 92", engage the shoulder to prevent removal of clip 30". At the same time, middle section 44" of clip 30" is positioned within window 94" of insert 50". Wall 96" of insert 50" surrounding window 94" engages middle section 44" of clip 30". In this position, wall 96" of insert 50" prevents clip 30", and tip 20" of tube 18" attached thereto, from withdrawing from insert 50" into spout body 12", specifically toward inlet end 14" of spout body 12", in a direction indicated by arrow W". According to an exemplary embodiment of the present disclosure, sealing ring 32" located in annular groove 34" of tip 20" contacts inner wall 52" of insert 50" to seal tip 20" of tube 18" and insert 50" when tip 20" is locked within insert 50".

Another step of the present method involves securing insert 50", and tube 18" locked therein, to outlet end 16" of spout body 12". As shown in FIG. 5B, insert 50" may have a shape that corresponds to the shape of spout body 12" to facilitate a mating engagement between the components. The shape of insert 50", which corresponds to the shape of spout body 12", may prevent insert 50" from withdrawing into spout body 12" in a direction indicated by arrow W" and from advancing through spout body 12" in a direction indicated by arrow A". Also, as shown in FIG. 5B, insert 50" may be coupled to constraining ring 100", to further mate with spout body 12". In one embodiment, spout body 12" may include shoulder 74". Like insert 50 (FIG. 1B), insert 50" may be larger at its base to engage shoulder 74" of spout body 12". Constraining ring 100" may also engage shoulder 74" of spout body 12". According to an exemplary embodiment of the present disclosure, tube 18" is sealed and locked within insert 50", and insert 50" is secured to spout body 12" to prevent movement of insert 50" in a direction indicated by arrow W" and in an opposite direction indicated by arrow A".

Another step of the present method involves coupling aerator 80" to outlet end 16" of spout body 12". Aerator 80" provides for proper discharge of water from faucet spout 10". Advantageously, because tube 18" is sealed and locked within insert 50", and insert 50" is secured to spout body 12", aerator 80" may be cleaned and/or replaced without disturbing the other components. As shown in FIG. 5B, aerator 80" may be designed to attach directly to insert 50". For example, aerator 80" may include male threads 86" and insert 50" may include female threads 88" configured to threadably engage male threads 86". In another embodiment, aerator 80" may be snapped into place within insert 50". Such attachments facilitate removal of aerator 80" when necessary.

While this invention has been described as having preferred designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A faucet comprising:

a spout body having an inlet end and an outlet end, the spout body defining a chamber extending between the inlet end and the outlet end;

a tube received within the chamber of the spout body, the tube having a tip disposed proximal the outlet end of the spout body, the tip having a first shoulder;

an insert configured to couple to the outlet end of the spout body, the insert having a second shoulder, the first shoulder of the tip being configured to abut the insert to prevent the tube from advancing from the spout body in a first direction; and a clip configured to engage the second shoulder of the insert to prevent the tube from withdrawing into the spout body in a second direction.

2. A faucet comprising:

a spout body having an inlet end and an outlet end, the spout body defining a chamber extending between the inlet end and the outlet end;

a tube received within the chamber of the spout body, the tube having a tip disposed proximal the outlet end of the spout body, the tip having a first shoulder;

an insert configured to couple to the outlet end of the spout body, the insert having a second shoulder and at least one snap, the at least one snap being configured to engage the spout body and the first shoulder of the tip being configured to prevent the tube from advancing from the spout body in a first direction; and a clip configured to engage the second shoulder of the insert to prevent the tube from withdrawing into the spout body in a second direction.

3. A faucet comprising:

a spout body having an inlet end and an outlet end, the spout body defining a chamber extending between the inlet end and the outlet end;

a tube received within the chamber of the spout body, the tube having a tip disposed proximal the outlet end of the spout body, the tip having a first shoulder spaced apart from a lower end of the tip;

an insert configured to couple to the outlet end of the spout body and receive the tip of the tube, the insert having a second shoulder, the first shoulder of the tip being configured to prevent the tube from advancing through the insert in a first direction toward the outlet end of the spout body; and a clip configured to engage the second shoulder of the insert to prevent the tube from withdrawing from the insert in a second direction into the spout body.

4. The faucet of claim 3, further comprising an aerator configured to couple to the insert.

5. The faucet of claim 3, wherein the clip comprises a substantially C-shaped body.

6. The faucet of claim 3, wherein the clip is configured to collapse within an outer periphery of the spout tip.

7. The faucet of claim 3, wherein the tip comprises at least one annular groove configured to receive the clip.

8. The faucet of claim 7, wherein the tip comprises a second annular groove configured to receive a sealing ring.

9. An apparatus configured to retain a spout tube within a spout body of a faucet, the spout tube having a tip, the apparatus comprising:

a spout body having an inlet end and an outlet end, the spout body defining a chamber extending between the inlet end and the outlet end;

a spout tube received within the chamber of the spout body, the spout tube having a spout tip disposed adjacent the outlet end of the spout body;

an insert coupled to the outlet end of the spout body, the insert having a narrowed inlet portion and a widened outlet portion; and a clip having a substantially C-shaped body, the clip configured to collapse within an outer periphery of the spout tip in a first position within the narrowed inlet portion of the insert, such that an outer diameter of the clip is less than an inner diameter of the narrowed inlet portion of the insert, and the clip configured to expand beyond the outer periphery of the spout tip in a second position within the widened outlet portion of the insert, such that the outer diameter of the clip is greater than the inner diameter of the narrowed inlet portion of the insert.

10. The apparatus of claim 9, wherein the body of the clip extends between two terminal ends, the terminal ends being configured to engage the spout tip when the clip is in both the first position and the second position.

11. The apparatus of claim 9, wherein the body of the clip extends between two terminal ends, the two terminal ends being located closer together when the clip is in the first position than when the clip is in the second position.

12. The apparatus of claim 9, wherein the clip is constructed of an elastic material and is biased toward the second position.

13. The apparatus of claim 9, wherein the body of the clip comprises two terminal ends, a middle section located between the two terminal ends, and least one expansion section located between at least one of the two terminal ends and the middle section, the at least one expansion section being configured to engage the spout tip when the clip is in the first position.

14. The apparatus of claim 13, wherein the middle section is configured to engage the spout tip when the clip is in both the first position and the second position.

* * * * *